US008188873B2

(12) United States Patent
Barth et al.

(10) Patent No.: US 8,188,873 B2
(45) **Date of Patent: *May 29, 2012**

(54) SYSTEM AND METHOD FOR DETECTION OF A VARIETY OF ALARM CONDITIONS

(75) Inventors: R. Thomas Barth, San Diego, CA (US); William D. Baker, LaQuinta, CA (US)

(73) Assignee: Dtection, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/186,499

(22) Filed: Aug. 5, 2008

(65) Prior Publication Data

US 2009/0201162 A1 Aug. 13, 2009

Related U.S. Application Data

(60) Provisional application No. 60/954,545, filed on Aug. 7, 2007.

(51) Int. Cl.
*G08B 21/00* (2006.01)

(52) U.S. Cl. ..... 340/605; 73/40

(58) Field of Classification Search ..... 340/605, 340/603, 539.1, 604, 618, 612; 137/312; 73/40, 46

See application file for complete search history.

(56) References Cited

U.S. PATENT DOCUMENTS 5,334,973 A 8/1994 Furr
6,025,788 A * 2/2000 Diduck ..... 340/870.16
6,147,613 A * 11/2000 Doumit ..... 340/605
6,526,807 B1 * 3/2003 Doumit et al. ..... 73/40.5 R
6,552,647 B1 4/2003 Thiessen et al.
6,816,069 B2 11/2004 Quigley
6,892,751 B2 * 5/2005 Sanders ..... 137/312
7,032,435 B2 4/2006 Hassenflug
7,218,237 B2 5/2007 Kates
7,253,741 B2 * 8/2007 Fiorletta et al. ..... 340/605
7,360,413 B2 * 4/2008 Jeffries et al. ..... 73/195
7,561,057 B2 * 7/2009 Kates ..... 340/605
7,583,198 B2 * 9/2009 Kates ..... 340/605
7,900,647 B2 * 3/2011 Tornay ..... 137/15.11
2007/0289635 A1 * 12/2007 Ghazarian et al. ..... 137/312

* cited by examiner

*Primary Examiner* — Toan N Pham
(74) *Attorney, Agent, or Firm* — Foster Pepper PLLC; Richard T. Black

(57) ABSTRACT

A water leak detection and active surveillance system applied to one or more single or multiple-story buildings that timely alerts and contacts a decision maker(s) of the leak so that that corrective intervention may be implemented. The system includes multiple water detection endpoints and a base station that is connected by wireless transmission or other communication means. The system also includes a central server which augments the alarms with text messaging and emails as well as maintains a customer database of all water incidents and alarming procedures. The system also monitors the functionality (operating health) of all detection components. The system also provides proprietary access to the database by qualified users through an internet portal. The system includes the capability to implement a water shutoff action to the water source of the affected building. The system can also operate in mixed mode detection where it can detect a combination of alarm conditions such as smoke, motion, etc.

1 Claim, 15 Drawing Sheets

ANTENNA:
0.05" trace width
3 sq. inches
minimum enclosed area.
Minimize Perimeter
No ground plane
*Fig. 4*
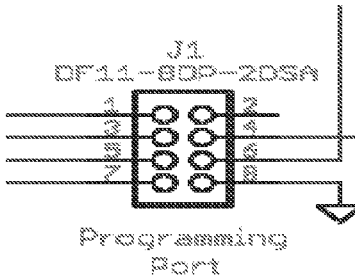
*Fig. 5*
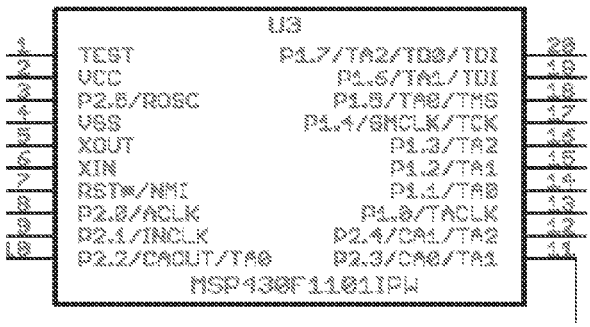
*Fig. 6*

SYSTEM AND METHOD FOR DETECTION OF A VARIETY OF ALARM CONDITIONS

PRIORITY CLAIM

This application claims priority to incorporates by reference in its entirety U.S. Provisional Patent Application No. 60/954,545 filed Aug. 7, 2007. That application incorporates by reference in their entirety U.S. Provisional Patent Application No. 60/654,663 filed Feb. 18, 2006 and U.S. patent application Ser. No. 11/357,400 filed Feb. 17, 2006. All applications incorporated by reference in their entirety.

SUMMARY OF THE INVENTION

In one embodiment a wireless, battery powered, cost effective, pro-active detection system and method for a variety of alarm conditions.

BRIEF DESCRIPTION OF THE DRAWINGS

Preferred and alternative embodiments of the present invention are described in detail below with reference to the following drawings.

FIG. 4 is a component of the circuit of FIG. 4;

FIG. 5 is another component of the circuit of FIG. 4;

FIG. 6 is another component of the circuit of FIG. 4;

FIG. 11 is an electronic schematic for the base station;

FIG. 12 is an enlarged section of the circuit of FIG. 15;

DETAILED DESCRIPTION OF ONE EMBODIMENT

Figure 1:
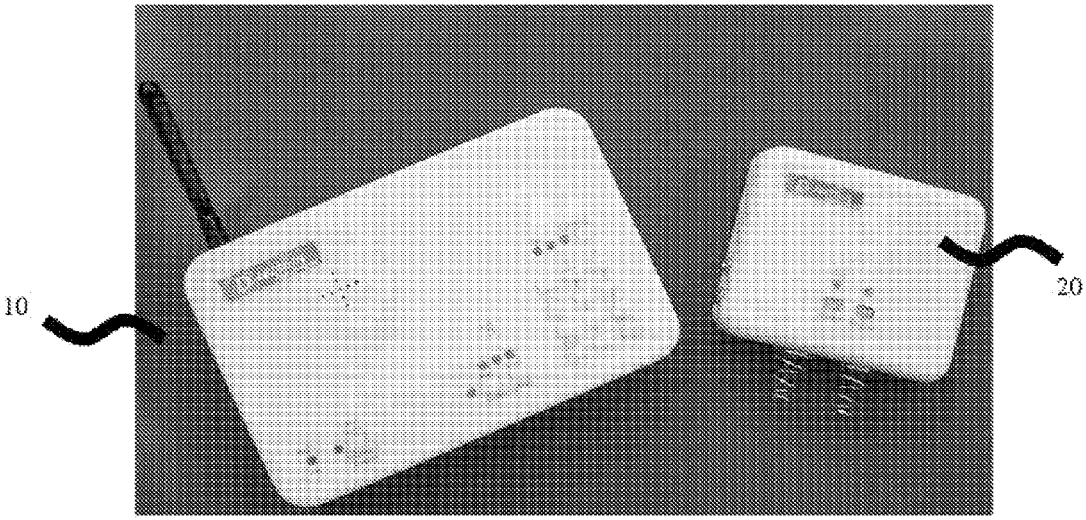
FIG. 1 is a picture of a base station and a detector in one embodiment.

One embodiment includes a water detection system that optionally has multiple water detection endpoints and a base station that is connectable to the telephone. In one embodiment, both parts of the system are capable of being battery powered. These endpoints monitor for the presence of water. When water is detected, the system promptly or timely sends a digital message to the base station using a radio link. In one embodiment, each endpoint has a serial number that is registered with the base station during system installation. Preferably, there are one or more test buttons or means on each endpoint allowing for testing and registration during the installation process. Preferably the system self monitors and alerts the base station if there is a malfunction. Preferably, the base station has a radio receiver to receive messages from the endpoints and is connected to the telephone system enabling it to send voice messages to one or more telephone numbers. In one embodiment, by using the DTMF generator, one-way digital messages can be sent from the base station to the central server. In one embodiment, a water detection, alarm and monitoring system that timely detects and notifies the occurrence of water leaks in occupied and unoccupied structures so that water damage is minimized or avoided. The water detection system is an active surveillance system and is applied to single or multiple structures throughout a defined geographical area. The single or multiple structures may be occupied or unoccupied. The system alarms and notifies a decision maker of the leak occurrence so that a corrective intervention may be quickly initiated, and implements a water shutoff action to the water source of the affected building.

Remote surveillance and alerting of water detection throughout multiple structures in widely dispersed geographic areas is achieved by simultaneously monitoring water detectors in the various locations units via multiple auto dialers in errorless CRC communication with a central server. Confirmation of water detector operability in buildings or multiple building complexes having installed water detectors is achieved by confirming that self-diagnostic end points are maintained via CRC handshake protocols for all transmission. Status information is sent to the central server and displayed via the portal.

The system utilizes multiple water detection endpoints and a base station that is connected to by telephone and other communication formats, and is backed-up by independent power systems should there be regional power failures through the region of surveillance. These endpoints monitor for the presence of water and upon detection, an analog or digital message is sent to the base station using a radio link or alternatively, ground communication. Each endpoint has a serial number that is registered with the base station during system installation. There are two test buttons on each endpoint allowing for testing and registration during the installation process. The system self monitors and alerts the base station if there is a malfunction. The base station has a radio receiver to receive messages from the endpoints and is connected to the telephone system enabling it to send voice messages to several different telephone numbers. By using the DTMF generator, one-way digital messages can be sent from the base station to the central server where information is compiled, databases are maintained, and additional calls-to-action are performed. Further the system preferably includes State machines and use of the processor in a multitasking mode.

Other embodiments of the invention relate to business methods for distributing and placing the water leak detection system in individual and multiple structures throughout a defined geographic region.

Yet other embodiments allow remote surveillance, detection and alerting of molds developing from water damaged structures. Similar to the water detection embodiments, the mold detection embodiments simultaneously monitors and collects data from a plurality of buildings and uses multiple auto dialers in communication with the base stations to confirm that in-structure mold detectors are operational. Operability of the mold detectors is achieved by confirming that self-diagnostic end points are maintained via CRC handshake protocols.

Yet other embodiments apply to surveillance and alerting of the appearance of smoke, fire, carbon monoxide, panic, irrigation, motion, and power outages in CRC based protocols respectively in confirmable communication for operability with respective smoke, fire, carbon monoxide, panic, irrigation, motion, and power detectors installed in multiple structures.

In one embodiment, a base station is designed to function in different modes. The active mode is normal detection. The sleep mode is appropriate when cleaning (with water) is taking place. There is a 30-minute auto restart. Another mode is the termination mode used for false alarms. Also the base station has a low battery notification for base station and transmitters. In set-up mode, each function is voice actuated for ease of use. A user can program a custom voice message up to 30 seconds in length. Finally each voice message is acknowledged and recorded. In one embodiment, a user can auto program up to 10 phone numbers for remote alarming with customized voice messages. Further, an embedded 800 number calls a central server for further backup with phone messages, text messages, emails and reports. In one embodiment transmitters auto 'check in' to insure 24/7 monitoring operations, unique ID's are registered for both transmitters and base stations.

In one embodiment local alarming can only be stopped by manually pushing the silence button. This assures a time of response is recorded in minutes. Data transmissions are encoded and checked to insure data accuracy. There are up to 32 transmitters can be attached to a single base station. These transmitters are designed allow for extended water coverage.

In one embodiment a central server monitors the detection system. The central server is ready 24/7 to answer any base station's incoming call for help. The central server decodes the phone message to retrieve the type of alarm, the ID of the base station and alarming transmitter and a plurality of functional info flags. It further correlates the base station information with a central database of user information. Next the central server calls back customer's primary number if not acknowledged, sends emails and text messages to customer defined addresses, and provides details on when and where the leak was detected. In one embodiment the central server documents the incident by date and time, documents and tracks response time, archives all incidents for later recall and reporting, requests a resend from base station if error was detected in transmission, checks on the health of the transmitters on a periodic basis, and sends emails for maintenance tracking. The web-based portal enables qualified users to access the on-line dashboard to monitor, diagnose, and edit all Detector equipment installed in their building(s). From the portal, users can evaluate water intrusion events, alarm history, system health status, customize their e-mail or text message recipient list and expand coverage by adding additional devices.

An embodiment of the present invention includes an intelligent sensing device that can recognize the type of problem detected and take appropriate action. The intelligence encoded into the invention enables the detectors to transmit a signal that tells the auto-dialer what phone numbers to dial and what type of problem was detected. In one embodiment, the auto-dialer component is connected to a phone line. Multiple lines are available so the unit can properly call the appropriate numbers for each type of detection.

In one embodiment, a detection device is a passive product and will sound a local alarm when water is detected. In an alternative embodiment, a detection device is an active product and will both generate a local alarm and initiate communication to an outside source via an auto dialer attached to the local phone line. In an alternative embodiment, the detection device shuts water off at the main water line when a water leak is detected. This is preferably done by a transceiver attached to an electronic valve that is embedded in the water line. In the one embodiment, an auto dialer is embedded in the detection device. In alternative embodiments, the water sensors can be installed to detect minimum water levels, including ambient moisture in the air, a rise in humidity and detect lower levels of stagnant water. One embodiment, there is an auto dialer, which dials an emergency number, which is embedded in the device. Using no mechanical parts, the water sensors are triggered by a moisture bridge across the sensor contacts.

In one embodiment, the detection device will alert a user with a loud audible alert in the presence of any moisture buildup. The alarm is sounded whenever water comes into contact with the sensors connected to the water alarm. Only a slight amount of dampness will set off the alarm. The detection device preferably uses AAA batteries which the device or alarm senses when battery is losing power and will inform a user that battery is low.

In an alternative embodiment, the detection device includes a transmission device that sends a signal to an auto-dialer whenever water comes in contact with the sensors as well as sounding an alarm. This provides another level of protection and consequently does not require a person to be physically present when the device senses a water mishap. In one example, the auto-dialer calls a local dispatcher or in the case of condominiums, it could be the 24-hour concierge service. It could even be the owner's own cell phone. The phone call would identify a water leak by unit number, day and time. The auto-dialer in one embodiment is connected directly to the phone line and draws power from a battery rated to last for three years. So even in an electrical outage, these detectors will still operate. The base unit includes up to nine telephone numbers.

In an alternative embodiment, the detection device includes a transmission device that sends a signal to an auto-dialer notifying that a leak was detected and in addition it sends a signal to an electronic valve that shuts off the water from the main line water source. This detection device would require a valve installed into the main water line but still be a wireless device.

In an alternative embodiment, a detection device includes a transmission device that sends a signal to an auto-dialer as well as sounding a local alarm. This provides a security level of protection when no one is home. The base unit includes nine telephone numbers and one would be dedicated to the motion detectors.

In one embodiment a base station is designed for other detector types in mixed mode operation (detecting mixed conditions such as motion, CO, smoke, etc.) The detectors, base unit and valve disconnect are intelligent devices in addition to having local alarm capabilities. They have embedded micro-code that provides a level of intelligence. All devices are programmed so the micro-code (software) in the auto-dialer can recognize the signal that was generated from either water or motion or smoke and autodial the appropriate number. The Base Station can incorporate a number of different alarm messages based on the type of alarm detected (motion, smoke, CO, etc.). In addition, the detectors contain a small-timer circuit that periodically triggers a self-diagnostic program that tests the functionality of the detector. If the detector fails the test, the auto-dialer is notified and the appropriate call is made notifying a faulty device was detected.

In an alternative embodiment, in addition to the above logging information, the central server stores information, correlates it to a user database and as backup can call telephone numbers notifying that a mishap has occurred and give a recorded message. For example, the message might be "500 W Harbor unit 532 water detected under the sink." Since it is the intent of the company to add distributors by county across the US, each distributor could have this central server function.

In one embodiment, each system includes one or more water detection endpoints and a base station that is connected to the telephone. Both parts of the system are battery powered. In an alternative embodiment, the detector is powered by AC power.

In one embodiment, water detection endpoints are placed in areas subject to water leakage, such as under sinks or in laundry areas. These endpoints continuously monitor for the presence of liquid water. When water is detected, they send a digital message to the base station using a radio link. Each endpoint has a serial number that is registered with the base station during system installation. There are two test buttons on each endpoint to allow for testing and registration during the installation process.

In one embodiment the detector will be universal and allow to be placed anywhere and have the ability to detect water. In another embodiment, the detector will be custom fit to a particular appliance or pipe.

In one embodiment, the device will communicate at 315 MHz. Other frequencies consistent with wireless communication are employed as required. In an alternative embodiment the device will communicate anywhere on the radio wave spectrum.

In one embodiment, when water is detected, each endpoint sends a repeating message for 10.5 seconds. The reason for the 10.5 second transmission time is that the base station only listens once every 10 seconds. To ensure that a message from an endpoint is heard, it transmits for a period of time slightly longer than the wake-up interval of the intended receiver. Message transmission times are randomized according to serial number so that if multiple units simultaneously encounter water their messages will not collide and mutually annihilate one another resulting in failure of either message to get through. The messages are repeated for a time.

In one embodiment, endpoints also randomly report that they are alive and healthy. This reporting process can occur as often as hourly. If the base fails to hear an endpoint for a number of consecutive periods, it will alert the central server of an endpoint failure. The central server notifies the user of the failure and updates the web portal.

In one embodiment, endpoints can have an acoustic alarm so that the location of a water leak can be easily determined. The alarm could also optionally be beeped when the battery gets low.

In one embodiment, the base station has a radio receiver operating at the same frequency as the endpoints in order to receive messages from endpoints. It is also connected to the telephone system so that it can send voice messages to several different telephone numbers. Depending on the memory size, several different messages can be stored. For example, one message could indicate an endpoint failure, another could be a message to the central server, and yet another could be custom recorded by the user and sent to selected recipients. In an alternative embodiment the base station is connected to a local area network in order to alert a user to a detection of an alarm condition. Other preferable methods contacting a user include blue tooth technology, cellular technology, infrared technology, WiFi technology, Voice over Internet Protocols technology, 802.11 technology, and/or WiMax technology.

In one embodiment, the device uses a DTMF generator; one-way digital messages can also be sent from the base station to the central server. A digital message allows the central server to be automated, as opposed to a voice-only system, which could require live operators for reliable operation. Additionally, information such as the serial number of the endpoint that detected water can be reported. This allows the central server to know where in the building the leak occurred and what measures to take. In order to receive these messages, a DTMF to USB decoder will need to be designed or purchased (if such a thing exists) for central server use. The central server central server would not only log the activity but also redirect more information out to the concerned party such as water detected in attic. It would also send email notification to all concerned parties.

In one embodiment, the receiver wakes up for approximately 25 mS every 10 seconds and listens for an endpoint message. This significantly reduces the average battery drain and extends the battery life by a factor of about 400. Using this approach, the expected battery life is approximately 2 years under normal operation using alkaline cells.

In one embodiment, base stations also report into the central server approximately once per day to announce their health and the health of their flock of endpoints.

In an alternative embodiment the base unit may require the use of AC power or additional battery circuit development.

In an alternative embodiment, connectivity from the base station could be expanded to include the Internet using a local area network either wired or wireless. Other links like infrared could also be adapted and other radio frequencies as applicable. Sensors in addition to water could be added to the network such as motion, smoke, relays on doors and windows, photocells, electrically activated valves, and household appliance controls and monitors.

In an alternative embodiment, a more complex base station will be such that it will allow the auto-dialer to discern between detectors (water, smoke motion co etc) as well as the central console. In addition, more intelligence at the detector level would allow testing from remote locations.

In one embodiment the base station and detectors preferably, but not necessarily include the following features.

In one embodiment there will be a control button named record OGM ("outgoing message"): When pressed and held causes the dialer to begin recording a custom outgoing message. It will include a prompt to signal when recording should begin.

In one embodiment there will be a control button named play OGM: When pressed causes an outgoing message to play into the speaker so that it can be reviewed.

In one embodiment there will be a control button that silences the alarm: it shuts off the dialer's alarm tone after an alarm is detected. If it is pressed before the dialer has had a chance to make its calls, it will not make the voice calls. It can go ahead and make the digital call to the central server. The digital call may be made silently (no echo to the speaker of the dialing process) in this case.

In one embodiment there will be a dual function control named a register endpoint. If it is pressed, it begins the process of registering an endpoint. The next endpoint it hears sending with its registration flag set will be registered. The speaker may announce that the registration was successful and have a user press the silence button to stop the announcement. If the button is held, the dialer will call the base station to test that communications between the dialer and the base are operational. The results can be announced on the speaker.

In one embodiment there will be a process to load phone numbers: The * key may also be labeled "program". The # key may also be labeled "store to memory #". To program a number the user presses the * key, dials the number, presses the # key and the memory number. In one embodiment the dialer will verbally read back the number just entered. In an alternative embodiment the user will be able to press the # key and a memory location button and the device will verbally read back the number that is stored in that location.

In one embodiment if the * is pressed followed immediately by the # key (no phone number entered), followed by a memory location, that location is cleared and will no longer be dialed to report a problem. In one embodiment there will be 7 LEDs as indicator lights. In one embodiment the alarm LED will flash when an alarm has occurred. It can be cleared when the reset button is pressed. In an alternative embodiment the audio tone will enter an intermittent mode after a time if it is not reset to conserve the battery and extend the total alarm time. The tone will be sent intermittently. During this type of operation, the flashing ALARM light would indicate that an alarm condition exists.

In one embodiment a Record LED will flash when the OGM is being recorded. In one embodiment a Too Loud LED will flash if the person is speaking too loudly into the microphone while recording. In one embodiment a Too Soft LED will flash if the person is speaking too softly into the microphone while recording. In one embodiment an OK LED will flash if the person is speaking at the proper level when recording.

In one embodiment an RX ON LED will flash each time the radio wakes up and listens. This will be used as a test to ensure the device is still working properly. In one embodiment a Registering LED flashes when a registration is in progress.

Figure 12:
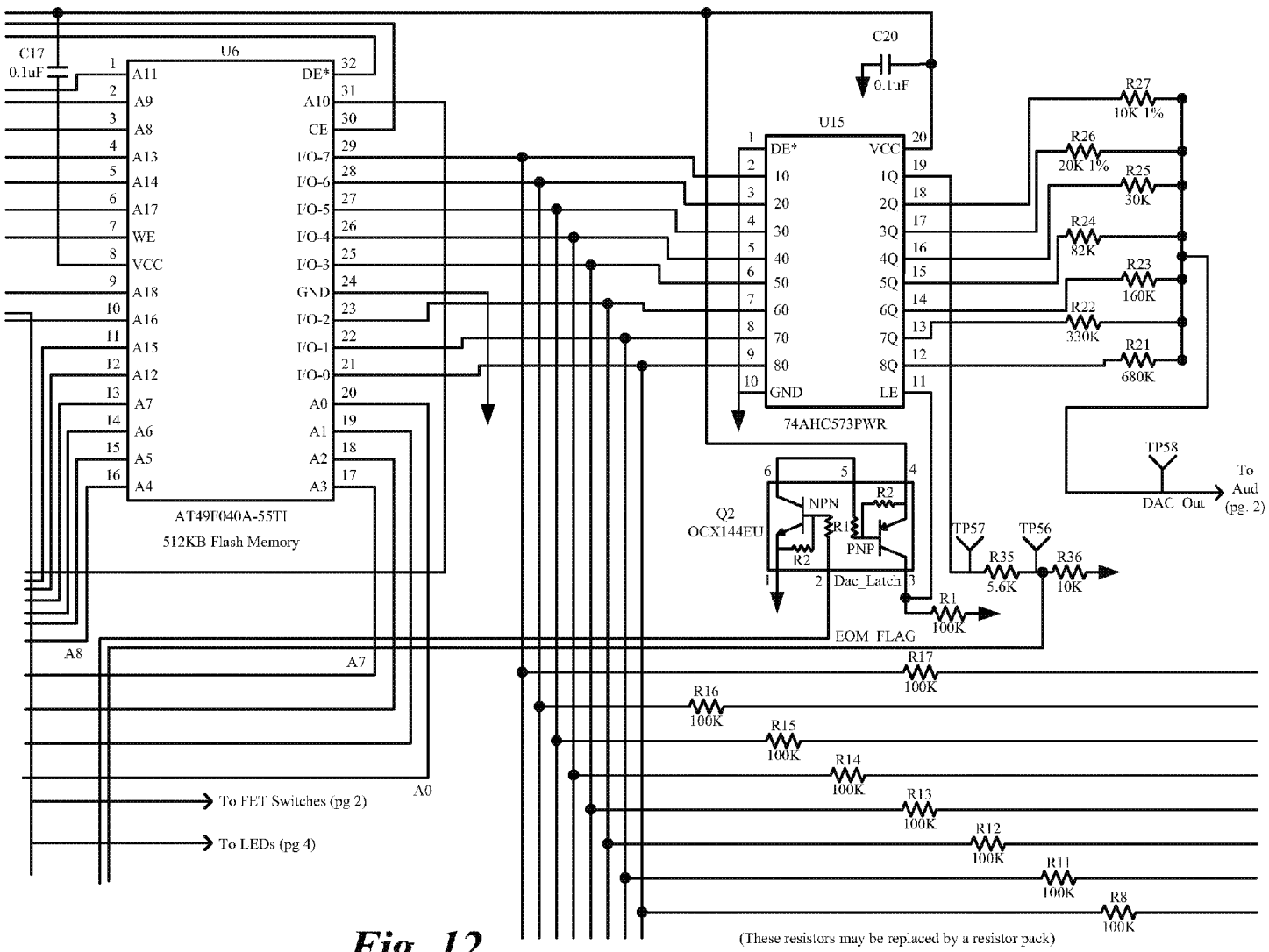
FIG. 12 is a flowchart that details the communications exchange that occurs between the dialer and the central server in one embodiment.
Figure 13:
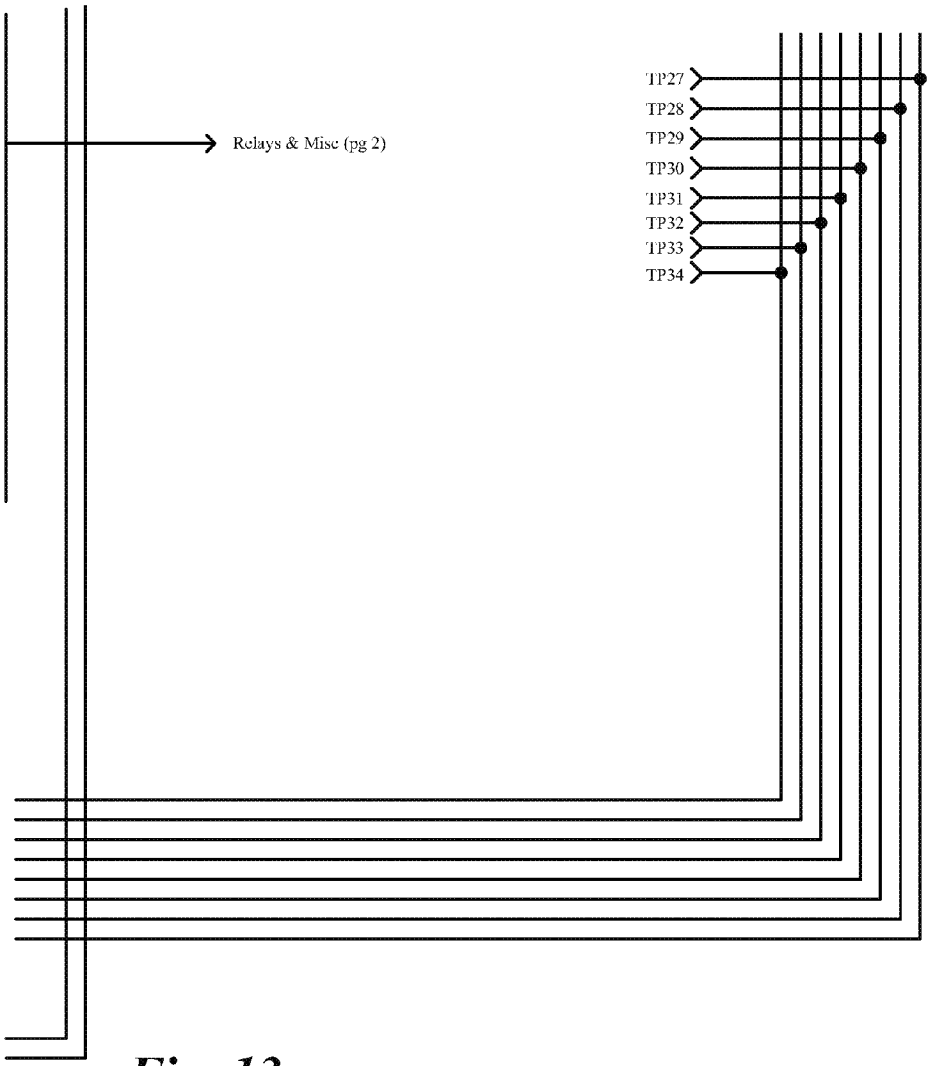
FIG. 13 is another enlarged section of the circuit of FIG. 15.

In one embodiment each DTMF symbol transmits four bits of data, or 1 hex digit. In one embodiment all messages are sent most significant bit (MSB) first (left to right in the FIG. 12 Message Type 1 definition).

In one embodiment there is a start function. This is the one nibble start character that indicates to the central server that the dialer is beginning a message. In one embodiment there is a type function. The message type defines the structure of the message. Message type 1 is of fixed length and format. Other types may have a totally different structure following the message type field. This will allow growth and backward compatibility. New dialers may have enhanced feature sets that cannot be handled by the type 1 message. In one embodiment there is a sequence # function. The sequence number updates each time the dialer sends a new message. This is useful if there is a communications fault between the dialer and the central server.

In one example embodiment the device will work in the following manner. Suppose that the dialer sends the central server a message, the central server confirms receipt, but the dialer doesn't get the confirmation. The dialer will hang up and redial the central server with the same message and the same sequence number. The central server would recognize this as a repeat of the previous message by the fact that the sequence number is the same as the previous sequence number and ignore the new message. The central server would, however, confirm receipt of the new message. If, however, the dialer had received a new fault indication (the old fault cleared and then reappeared), the dialer would call with a new sequence number. This would alert the central server that there was a new fault at the same place as the previous fault.

In one embodiment there is a Dialer Serial Number function. This stores the dialer's serial number in order to decipher which dialer has transmitted the signal. In one embodiment there is a Endpoint Serial Number function. This is the serial number of the endpoint that is reporting a problem. All central server database information (residence address, endpoint placement, etc.) is keyed to the endpoint's serial number. In one embodiment there is a Flags function. This indicates the type of situation that is being reported by the message. There are 8 bits here. The error associated with each is defined as follows: bit 0: Dialer battery is low; bit 1: Endpoint battery is low; bit 2: Voice message #1 (primary number) has been sent and confirmed received; bit 3: Water alarm.

In one embodiment if the dialer is calling to report that its battery is low or that all is OK, then the endpoint serial number will be set to zero. In one embodiment if the dialer is calling to check in (weekly or monthly "I am alive and well" message) all of the flag bits will be set to zero as will the endpoint address. If the dialer's battery is low, bit 0 will be set.

In one embodiment there is a 61-bit CRC function. The CRC is computed on all bits EXCEPT the START bit. The CRC polynomial used is 0x11021. This is the CCITT polynomial. When computing the CRC, the seed bits (bits placed in the CRC's position when computing the CRC) are 0xFFFF. Additionally, a byte with the value 0x80 is placed in front of the entire message and computed into the CRC. This is required to ensure detection of missing leading zeros. When checking the CRC, the result of the CRC will equal the seed if the message is good.

Figure 10:
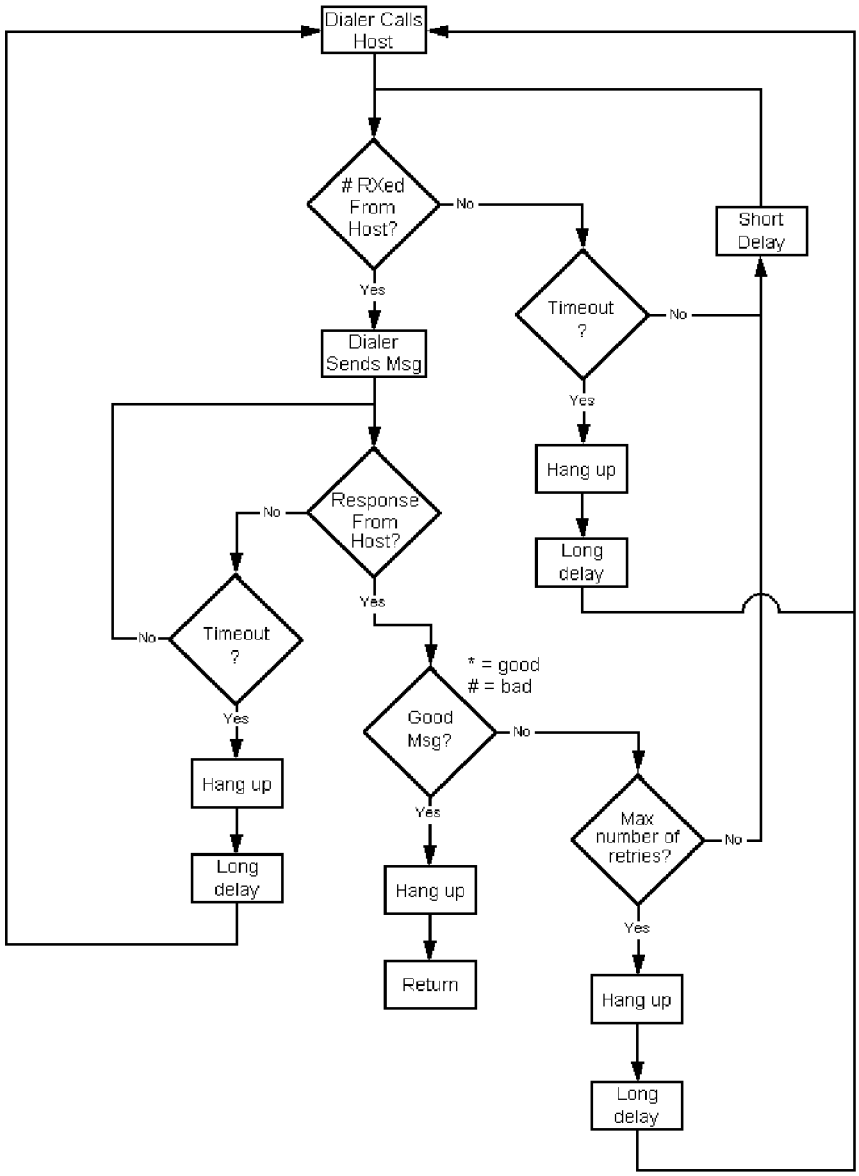
FIG. 10 is a logic diagram of a detection process.
Figure 11:
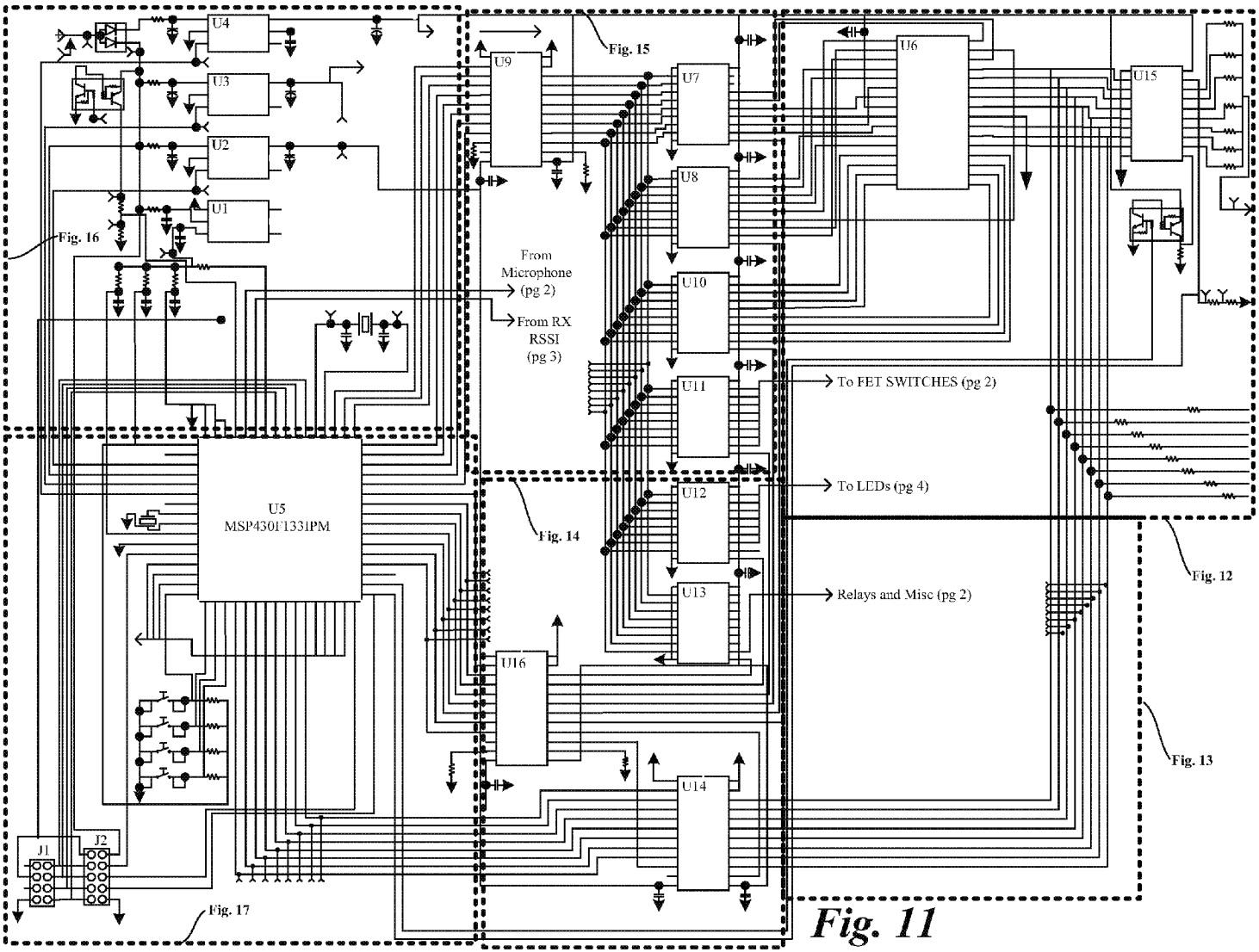
FIG. 11 is a table of the hex to DTMF mapping sequence.
Figure 14:
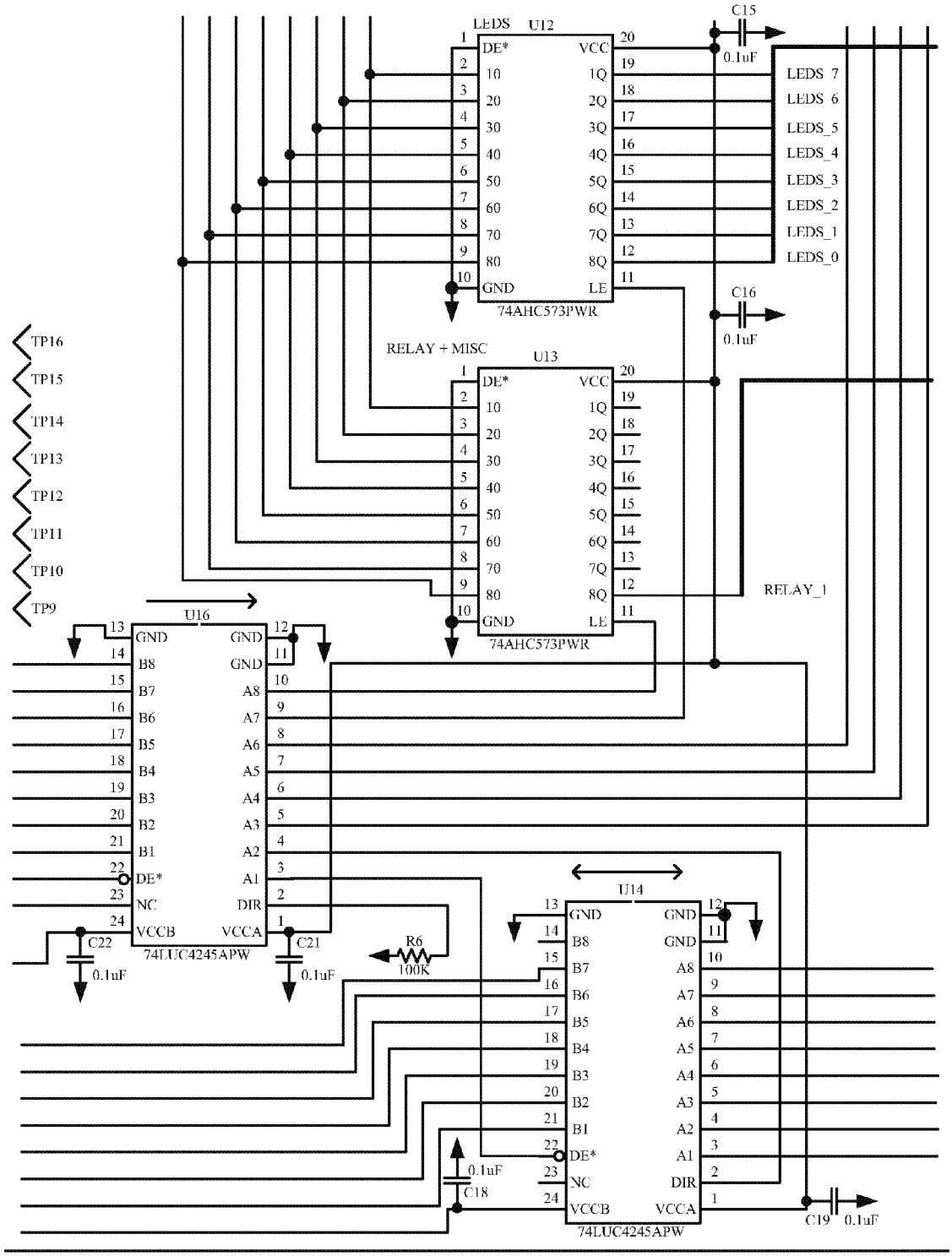
FIG. 14 is another enlarged section of the circuit of FIG. 15.
Figure 15:
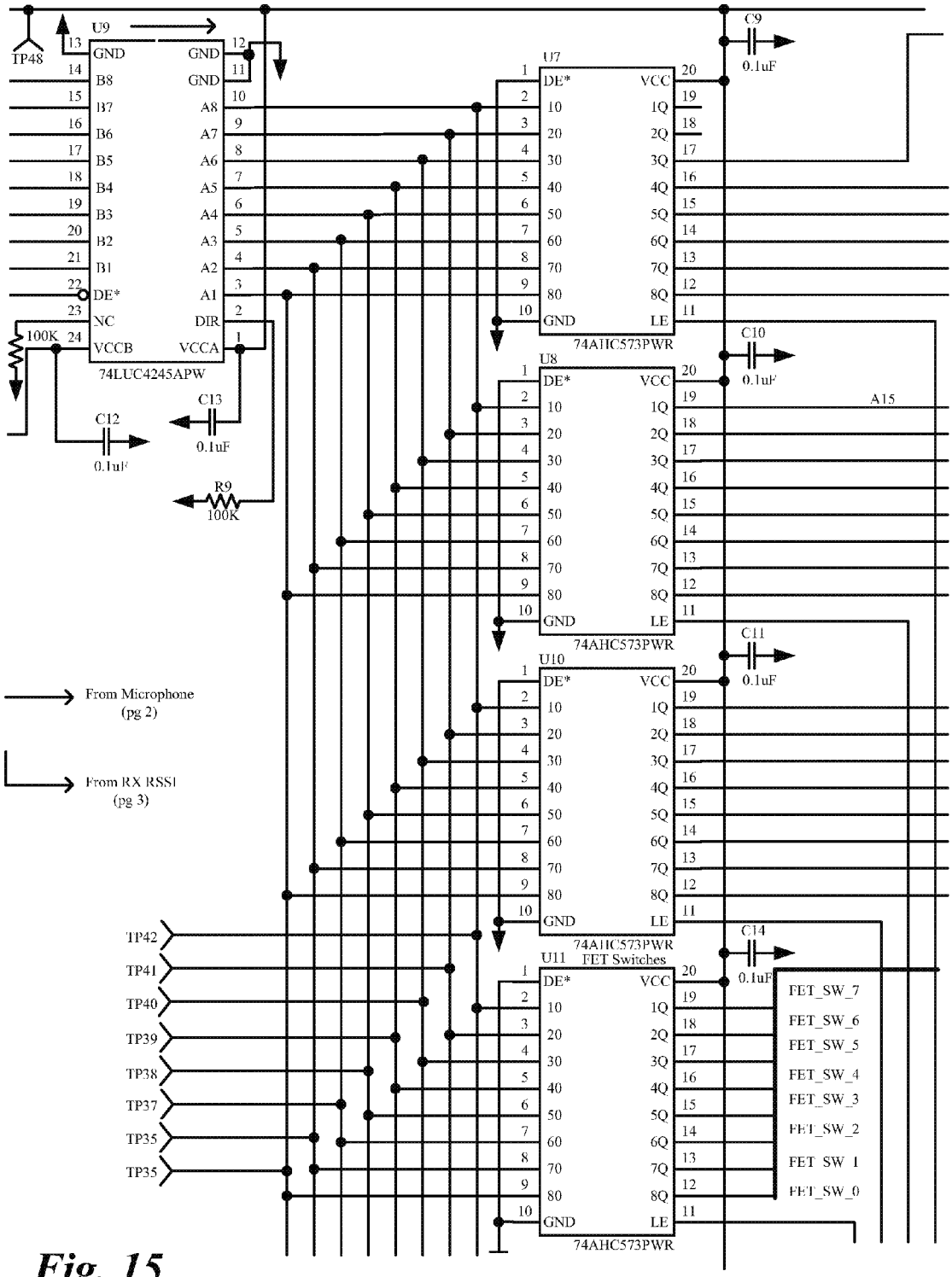
FIG. 15 is another enlarged section of the circuit of FIG. 15.
Figure 16:
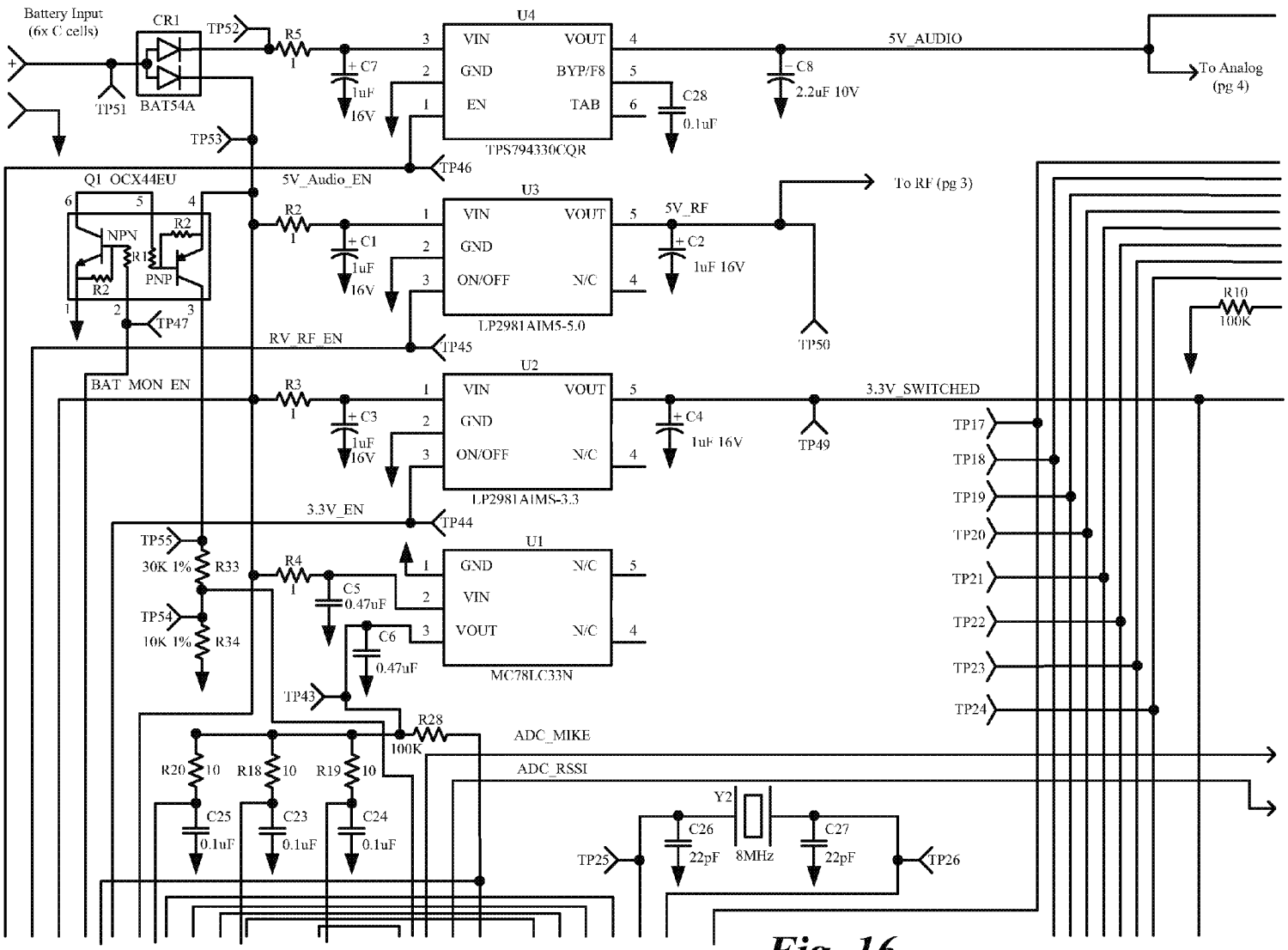
FIG. 16 is another enlarged section of the circuit of FIG. 15.
Figure 17:
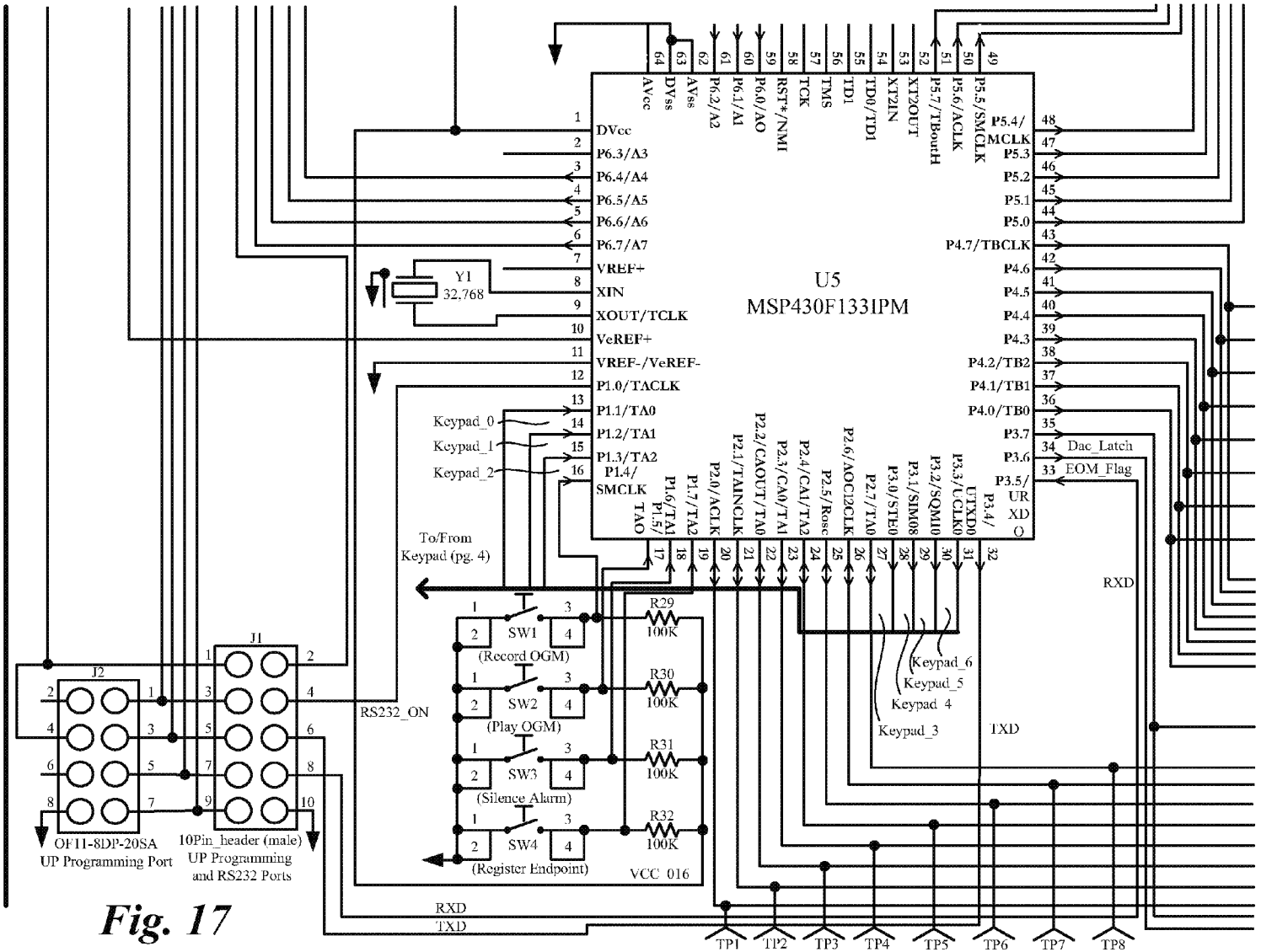
FIG. 17 is another enlarged section of the circuit of FIG. 15.
Figure 18:
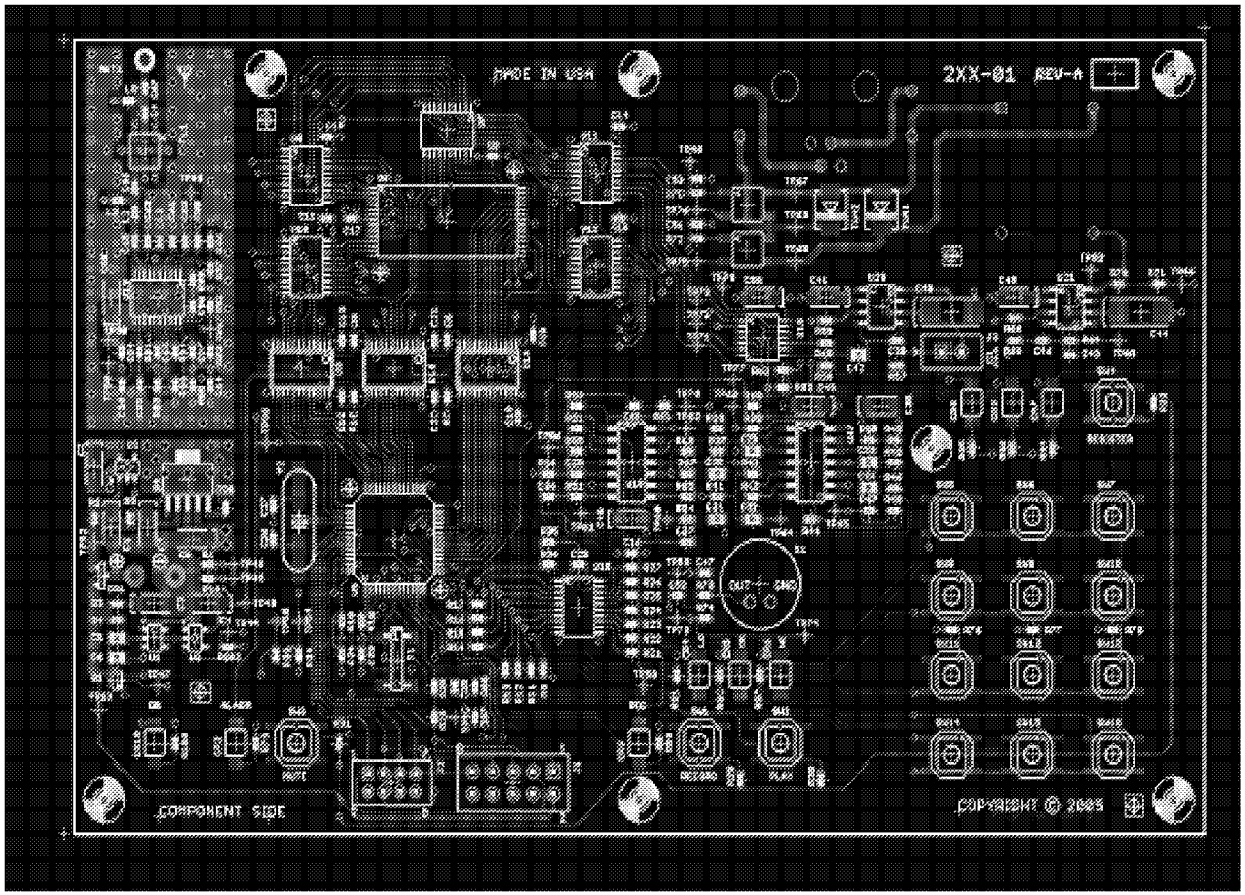
FIG. 18 shows the interior circuitry of one embodiment.

In one embodiment as shown in FIG. 10 the dialer calls the central server and waits for the central server to respond with DTMF #. Once this is received, the dialer sends the message to the central server. The central server then responds to the dialer with * if the message is good (CRC checks OK), or # if the CRC is bad. If the CRC is bad, the central server waits for a period of time (≈200 mS), and then sends another # to indicate that it is ready for the dialer to resend the message. If the message is resent a number of times without success, the dialer hangs up and tries dialing back at a later time. This prevents the process from going on forever if there is a noisy line or other problem with the channel. If the central server does not receive a message within 1 second of sending the # indicating to the dialer it is ready for a message, it needs to drop the line. A number of timeout conditions are shown in FIG. 14. These prevent the dialer from getting into a "hung" state should the central server line be busy, or if the central server fails to respond as expected for whatever reason. The central server has similar "escape routes" in case the dialer does not perform as it should.

One embodiment can include a test/silence button. If an alarm is in progress, the test/silence button can be pressed to stop the alarm from beeping. The test/silence button can additionally terminate all radio transmissions. In an alternate embodiment it is also possible to terminate transmissions before the dialer receives an indication of the leak. Further still if an alarm is silenced, in order for that alarm to detect a new alarm the device will "clear" after a minimum of one 10 second sensor test period without sensing water.

One embodiment generates a test message, which is transmitted for 10 seconds, when the test/silence button is pressed for approximately three seconds when an alarm is NOT in progress. The Test/Silence LED illuminated and/or the beeper sounds a continuous tone when the transmitter is sending the test message. Once the test message starts, all buttons are ignored for the duration of the test message. The test message is useful to ensure that the dialer can receive a transmitter after it is installed One embodiment includes a register button. When the Register button is pressed a single registration message can be transmitted. The beeper sounds and/or the Register LED is illuminated while the message is being transmitted. This is a short message that typically lasts approximately 100 ms. The register LED preferably flashes each time the sensor is tested for water leakage.

Further, one embodiment is configured such that when a new transmitter is installed a user can "register" the transmitter with its dialer. This is preferably accomplished by first pressing the Register button on the dialer and then pressing the Register button on the new transmitter. When the dialer hears the transmitter it will announce that the registration was successful. The dialer then knows the new transmitter's serial number and will report any alarms from that transmitter.

One embodiment includes an ability to send alarm messages for a period of 10 seconds. They are preferably repeated every 2 minutes for the duration of the alarm or until the silence button is pressed. When the message is being sent a continuous tone is emitted. Between transmissions, a pulsing tone is emitted.

Further, one embodiment is configured such that a transmitter can send an "I am here" message to the dialer once every two days. The time is approximate and varies according to the transmitter's serial number to minimize the likelihood of repeated message collisions. The transmitter can alert the dialer of a low battery condition whenever it transmits a message of any kind. Therefore, under normal conditions the transmitter will alert the dialer of its low battery condition during its "I am here" message every two days. The battery life, assuming no alarms, is approximately 5 years. If there are alarms, the battery life can be substantially shorter.

Also, the transmission can include the serial number, sequence number, detector type, and/or CRC seed value. All transmissions between transmitter and base station, as well as, base station to central console can undergo a CRC (cyclic redundancy checking routine) that assures that the transmission was not corrupted during transmission. If CRC does not check, then a new transmission is requested.

Other embodiments include confirmation of air quality, the confirmation of a mechanical event, such as the operation of a water shut off valve or the on-off action of a power switch, the existence of a medical emergency, and the identification of the locations of air quality, mechanical events, or medical emergences, is also achieved by confirmation via CRC handshake protocols. The automatic monitoring can be done in a central server.

Other embodiments relate to the deployment of the water leak detection system and related business methods to enhance placement of the system in geographically defined regions.

Figure 2:
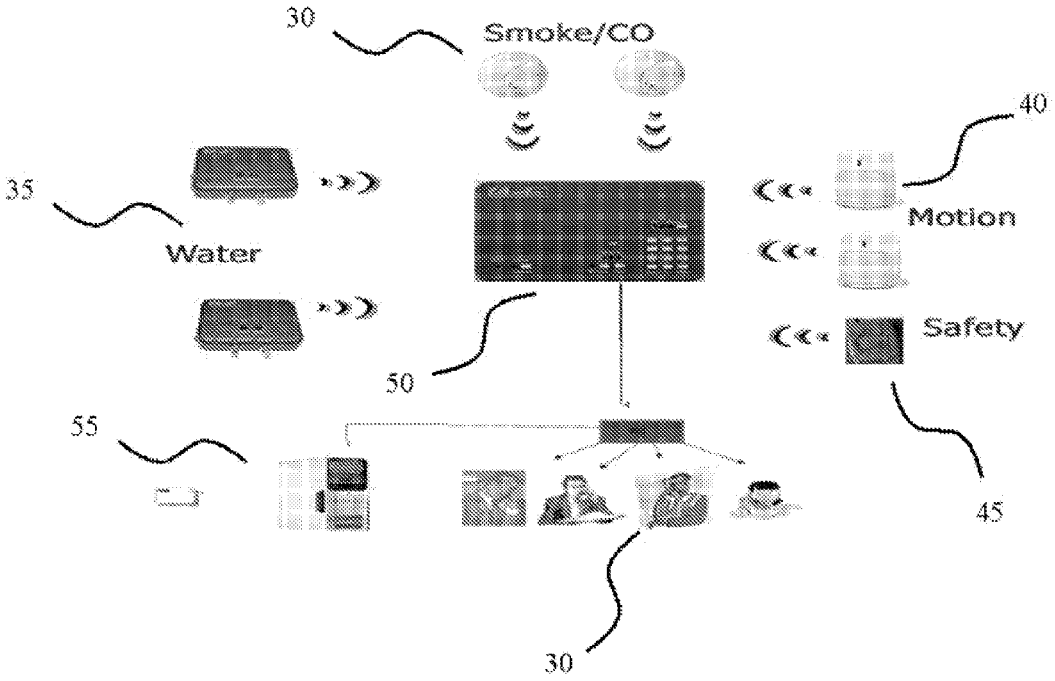
FIG. 2 illustrates a conceptual schematic of the system, in one embodiment.
Figure 3:
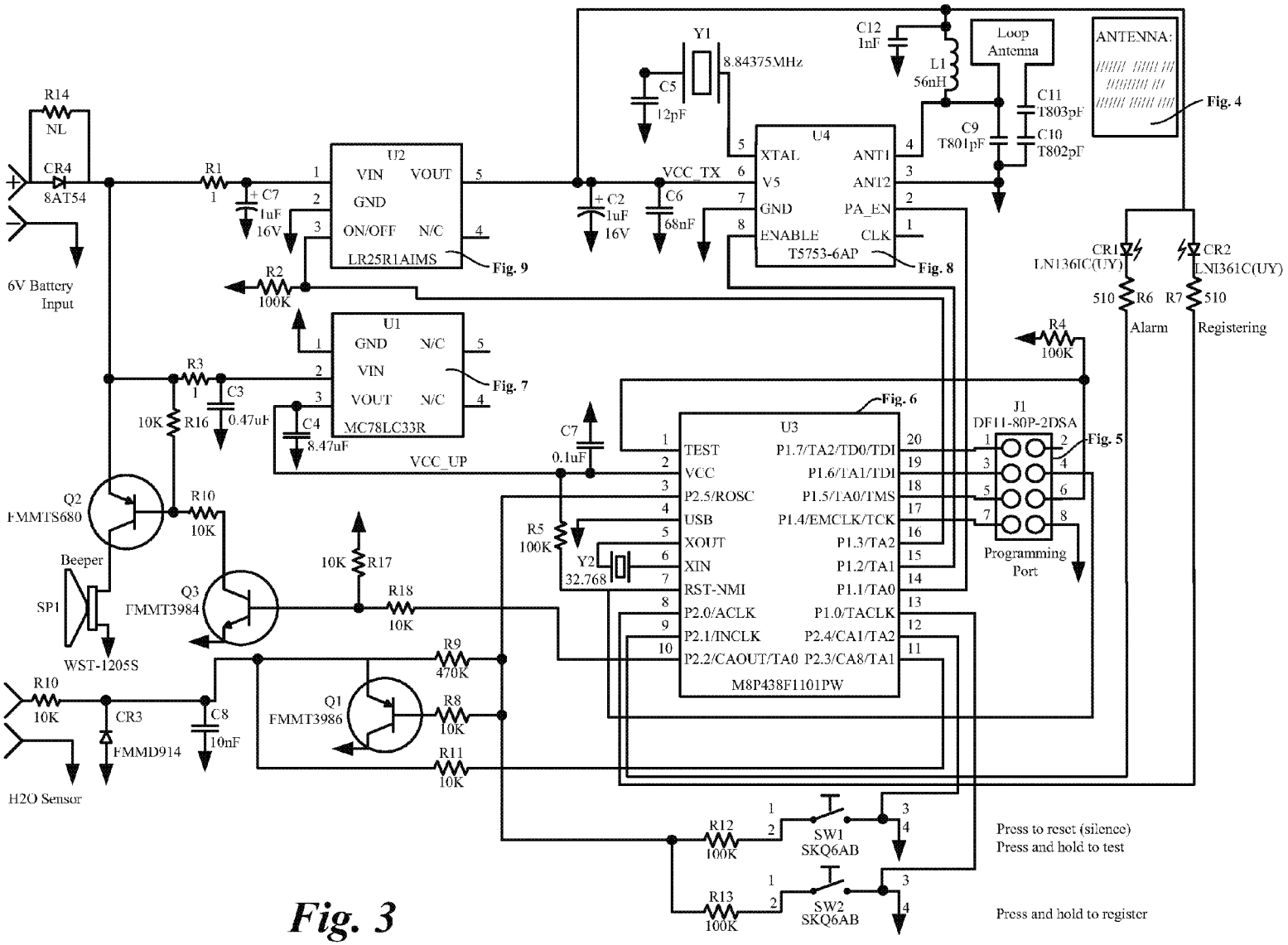
FIG. 3 is a circuit diagram of a detector in one embodiment.
Figure 7:
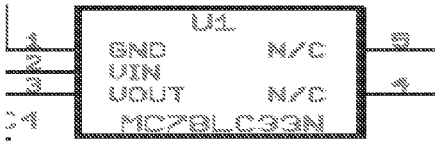
FIG. 7 is another component of the circuit of FIG. 4.
Figure 8:
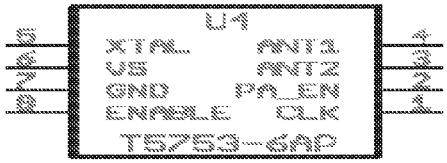
FIG. 8 is another component of the circuit of FIG. 4.
Figure 9:
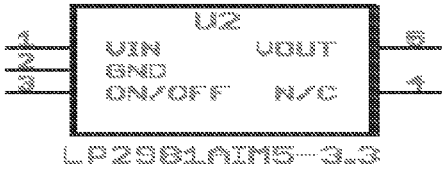
FIG. 9 is another component of the circuit of FIG. 4.

FIG. 1 shows an example base station 10, and detector 20. FIG. 2 shows a conceptual schematic of a detection system, in one embodiment, with a detector for smoke and carbon monoxide 30, a detector for water 35, a motion detector 40, and a safety/panic alarm 45, all operably connected to a base station 50. The base station 50 is operably connected to an autodialer 60 and a computer acting as the central server 55.

Figure 19:
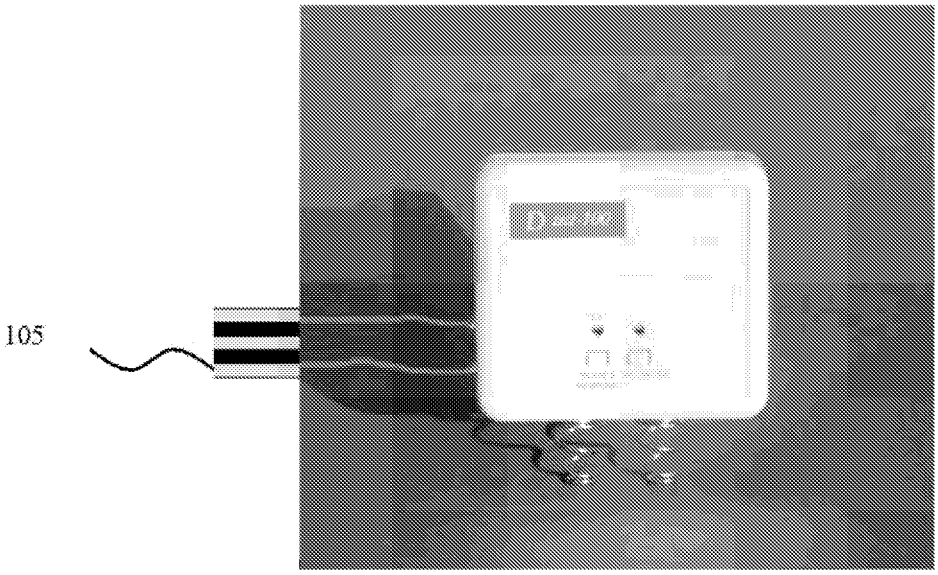
FIG. 19 shows conductor tape in one embodiment.

FIG. 19 shows the unique use of special conductor tape. In one embodiment the conductor tape will increase the detection range of a transmitter to over 200 feet. Any water coming in contact with the surface of the tape will trigger an alarm. In one embodiment, this is being incorporated in commercial and laboratory environments where coverage is important over the entire surface of a ceiling. It would be impossible to cover this area by using multiple transmitters. For example a transmitter can be placed in the attic or basement and the tape will provide protection to the entire periphery of the surface.

In one business method embodiment addressed to marketing, the detection and alarm systems are configured so that they are marketed for placement in households and other occupied or unoccupied properties to permit active surveillance of water leaks in a cost effective manner. From the active surveillance, the marketing program receives collateral information from the occupied properties. The collateral information is then used to produce flyers announcing the water leak detectors and detection systems that are mailed to a targeted market area. Thereafter, an expansion of the marketing campaign is developed so that a nationwide public relations program is implemented. Free publicity arising from the public relations program enhances the awareness level throughout regional or national territories. The awareness level is enhanced and maintained throughout the marketing cycle by product promotions at trade shows designed to bring distributors and customers together.

In another business method embodiment, a distribution model is used that licenses the water leak detection systems across the region or nation. The license is configured to give an exclusive distributorship by region or sub-region. For example, distributorships are designated by multiple state, single state, multiple county, or single county regions. The licenses in particular are further modified to attract restoration contractors. In one embodiment, these exclusive licenses will commit the distributor to minimum selling levels each year and the immediate purchase of the water leak detection products and systems.

In another business method embodiment, a direct market selling campaign is conducted in a defined geographical region about a major cosmopolitan area. For example, sales activities are concentrated in an approximate 100-mile radius of a major city, such as San Diego. Analysis of the sales distribution for the leak detection systems within the defined geographical region provides a track record and a business model for the distributors to predict market needs throughout the country. Another particular embodiment includes a business method to develop a market presence in a cosmopolitan region, such as downtown San Diego. The business method generally begins with making a sales call to place water detection units in a high-rise condominium for market testing and demonstration purposes.

In an alternate embodiment of this business method, insurance companies are solicited to support or otherwise endorse the placement of the water detection units as a means to lower insurance premiums. The lowered insurance premiums in turn further encourage the placement of more water detection units. Market segments pursued include National Property Managers Professional Associations, Homeowner Associations, Condominium and Apartment Developers, HUD, large time sharing complexes and retailers in the home improvement industry. Other market segments include hospitals, schools; assisted living facilities, government buildings, private residences and any structures that are sensitive to financial loses caused by undetected water leaks. Promotions to make the public aware and generate interest for the water detection systems include publishing via the Internet and trade journals, and engaging the public via public relations and conducting word-of-mouth campaigns. An Internet website referred to as Dtection.com prominently promotes the water leak detection system as previously described. The Dtection.com website further includes links to the various distributors, brochures for each product and pricing and licensing information for the distribution market.

Upon completion of marketing, public relations, and word-of-mouth campaigns, local and regional licenses to the target markets are offered to establish a revenue stream. The revenue streams are enhanced using a national distributor model to the target markets.

In one embodiment, in addition, a territory "command center" enables the distributor or independent sales agent who has been assigned to that territory to be the first responder to any problem being reported by the product. Any incident detected by any product will result in a telephone call to a central server for that region. (Regions will be defined by Detection Inc. based on distributor or independent sale agent coverage). The details of every incident (time, date, location, detector ID number, and type of problem) will be recorded. This "early warning" puts the distributor/agent in a very powerful position relative to how responses to the detected problems are handled.

In one embodiment, the company aims to develop, market and produce these products in the most cost effective method taking advantage of the numerous resources that are available; provide opportunities for OEM's nationwide to take advantage of these products on an ongoing licensing basis; encourage new audiences by promoting, developing and evaluating the products with an extensive PR campaign; build a web site that will display and describe the products and point the business to the appropriate distributor across the country; form a relationship with insurance firms that may not only recommend the products but also offer a discount to their clients for installing the product; attend home product shows to increase awareness of the product.

In one embodiment, the sales strategy will be distributor driven and will be based on census information provided by the Geostat Reference Desk at the University of Virginia to map the United States by counties. Distributors will be selected from within those counties upon a due diligence process. Counties that appear on the top 100 Counties in U.S. List will allow for more than one distributor. Quotas will be determined on a CBC basis.

While one embodiments of the disclosure has been illustrated and described, many changes can be made without departing from the spirit and scope of the invention. Accordingly, the scope of the invention is not limited by the disclosure of one, particular, and alternate embodiments.

The embodiments of the invention in which an exclusive property or privilege is claimed are defined as follows:

1. A water detection system comprising:

at least one water detector in a building, the water detector configured to send an alarm signal upon detecting a water leak event;

a central server; and a base station having a phone number database, the base station configured to receive the alarm signal and make outgoing phone calls to telephone numbers stored in the database, the base station further configured to communicate with the central server and optionally implement a water shutoff action without human intervention, wherein the central server receives information from the base station that includes details of the water leak event and stores the information in a customer database.

* * * * *